US005875852A

United States Patent [19]

Floyd et al.

[11] Patent Number: 5,875,852

[45] Date of Patent: Mar. 2, 1999

[54] APPARATUS AND ASSOCIATED METHODS OF PRODUCING A SUBTERRANEAN WELL

[75] Inventors: Terry L. Floyd; Dean S. Oneal, both of Lafayette, La.

[73] Assignee: Halliburton Energy Services, Inc., Dallas, Tex.

[21] Appl. No.: 807,112

[22] Filed: Feb. 4, 1997

[51] Int. Cl.[6] ..... E21B 33/12

[52] U.S. Cl. ..... 166/387; 166/191

[58] Field of Search ..... 166/387, 191, 166/126, 131, 133, 185

[56] References Cited

U.S. PATENT DOCUMENTS

| | | | |
|---|---|---|---|
| 2,978,046 | 4/1961 | True | 166/191 X |
| 3,247,904 | 4/1966 | Wakefield, Jr. | 166/191 X |
| 4,580,632 | 4/1986 | Reardon | 166/191 X |
| 5,474,127 | 12/1995 | White | 166/191 X |

*Primary Examiner*—William Neuder
*Attorney, Agent, or Firm*—Paul I. Herman; Marlin R. Smith

[57] ABSTRACT

A method and associated apparatus provide enhanced safety in subterranean well completions while permitting other production issues to be addressed efficiently and cost effectively. In a preferred embodiment, a method of producing a subterranean well utilizes an isolation packer having an inner mandrel through which fluid transmission lines and electrical transmission lines may be conveniently installed. A unique configuration of the packer permits a surface controlled subsurface safety valve, fluid property sensors, injection subs, etc., to be installed below the packer with the various lines used therewith extended axially through the mandrel.

96 Claims, 4 Drawing Sheets

APPARATUS AND ASSOCIATED METHODS OF PRODUCING A SUBTERRANEAN WELL

BACKGROUND OF THE INVENTION

The present invention relates generally to operations in subterranean wells and, in a preferred embodiment thereof, more particularly provides a method and apparatus for isolating a producing formation.

Modern advancements in well production technology have produced the capability of drilling wells in relatively deep waters offshore using floating production systems and production risers. Unfortunately, use of these systems raises certain safety concerns. For example, if a ship were to collide with a floating production system, at least the production tubing spar may be sheared off, presenting an urgent need to gain immediate control of the well.

Additionally, other issues are presented in such deep water completions, such as paraffin and hydrate formation, future workovers to install gas lift equipment after production has diminished, monitoring of fluid properties downhole, alleviating spar loading, and addressing these issues while containing the costs of the completions. Of course, not all of these issues are present in every such well completion, but the need does exist to be able to solve these problems in whatever combination they arise in a particular completion and, therefore, it would be advantageous to be able to solve them all in a single completion.

From the foregoing, it can be seen that it would be quite desirable to provide a method of producing a subterranean well which enables an operator to conveniently gain control of a well after a catastrophic event, such as shearing of the production tubing, while addressing issues such as paraffin and hydrate formation, monitoring downhole fluid properties, alleviating tubing spar loading, future workovers, etc., and accomplish these objectives while increasing the efficiency of the well production. It is accordingly an object of the present invention to provide such a method and associated apparatus therefor.

SUMMARY OF THE INVENTION

In carrying out the principles of the present invention, in accordance with an embodiment thereof, a method and apparatus for producing a subterranean well is provided which utilizes a unique combination of packers, tubing strings, valves, and other equipment to enhance safety and efficiency in completing the well. In one embodiment, a surface controlled subsurface safety valve is positioned below a packer, and the valve's control line is extended through the packer's mandrel to the earth's surface. In another embodiment, multiple tubing strings and a sliding sleeve valve are used to provide an annular fluid passage for circulation and/or gas lift purposes below an isolation packer.

In one aspect of the present invention, a method of producing a subterranean well is provided, the well having a wellbore intersecting a formation from which fluid is to be flowed to the earth's surface. The method includes the steps of providing a first packer having a first axial fluid passage; providing a second packer having a second axial fluid passage; providing a first tubing string including a first valve selectively permitting and preventing fluid flow axially through the first tubing string; interconnecting the first tubing string between the first and second axial fluid passages; setting the first packer in the wellbore between the formation and the earth's surface; and setting the second packer in the wellbore between the first packer and the earth's surface. An associated apparatus is also provided for use with this method.

In another aspect of the present invention, another method of producing a subterranean well is provided, the well having a wellbore intersecting a formation from which fluid is to be flowed to the earth's surface. The method includes the steps of providing a first packer having a first axial fluid passage; providing a second packer having a second axial fluid passage; providing a first tubing string including a first valve, the first valve selectively permitting and preventing fluid flow through a sidewall portion thereof; and interconnecting the first tubing string between the first and second axial fluid passages. An associated apparatus is provided for use with this method as well.

In still another aspect of the present invention, another method of producing a subterranean well is provided, the well having a wellbore intersecting a formation from which fluid is to be flowed to the earth's surface. The method includes the steps of providing a packer having an axially extending mandrel, the mandrel having a first fluid passage formed axially therethrough; providing a first tubing string having an inner side surface; connecting the first tubing string to the mandrel; setting the packer in the wellbore; providing a second tubing string; disposing the second tubing string at least partially within the first tubing string; and sealingly engaging the second tubing string with a portion of the first tubing string inner side surface. Another apparatus is provided for use in association with this method.

In yet another aspect of the present invention, a packer is provided. The packer includes an inner mandrel, an outer housing, a seal element, slip elements, and a conduit.

The inner mandrel is generally tubular and has inner and outer side surfaces. The outer housing is also generally tubular and at least partially radially outwardly circumscribes the inner mandrel. The seal element is circumferential and is carried adjacent the outer housing for sealingly engaging the wellbore. The conduit is formed in the inner mandrel between the inner and outer side surfaces and extends generally axially therein.

The use of the disclosed methods and apparatus permit wells to be more safely completed and produced, and increases efficiency of such production. In one embodiment of the present invention, production efficiency over time is particularly enhanced. Other objects, features, and benefits of the present invention will become apparent to one of ordinary skill in the art upon careful consideration of the detailed description of embodiments thereof hereinbelow.

DETAILED DESCRIPTION

Figure 1:
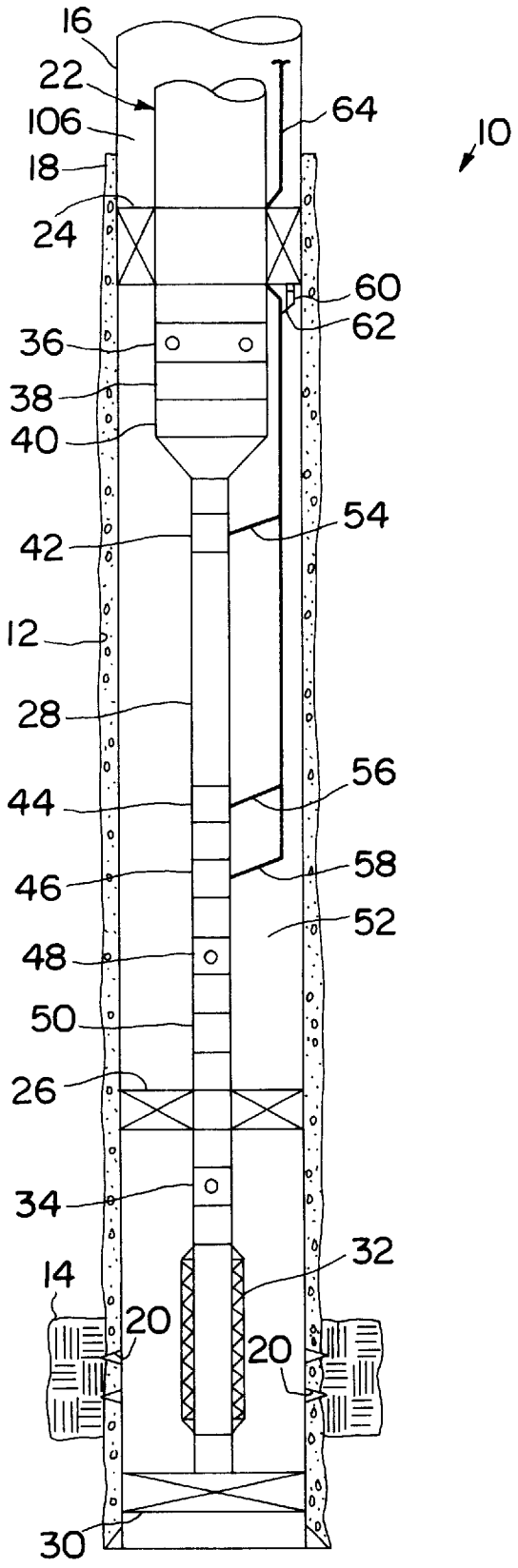
FIG. 1 is a partially elevational and partially cross-sectional schematicized view of a subterranean well wherein a method and apparatus embodying principles of the present invention have been utilized.

Representatively and schematically illustrated in FIG. 1 is a method 10 of producing a subterranean well which embodies principles of the present invention. In the following description of the method 10, and other methods and associated apparatus herein, directional terms, such as "above", "below", "upward", "downward", "upper", "lower", etc., are used for convenience in describing the embodiments as they are representatively illustrated in the accompanying drawings. Additionally, it is to be understood that the methods and associated apparatus man be utilized in various orientations, including vertical, horizontal, inclined, inverted, etc., without departing from the principles of the present invention.

As shown in FIG. 1, some of the steps of the method 10 have been performed within the well. Initially, a wellbore 12 is drilled into the earth to intersect a formation 14, from which it is desired to produce fluid. A liner or casing 16 lines the wellbore 12, and cement 18 is deposited between the wellbore and the casing. It is not necessary to case and cement the wellbore 12 according to the principles of the present invention, since the method 10 may be performed in an open, or partially open, wellbore with suitable modifications, for example, by replacing certain cased hole packers utilized in the method with open hole packers, etc. If the wellbore 12 is cased and cemented, perforations 20 are formed in a conventional manner through the casing 16 and cement 18 to permit fluid to flow from the formation 14 into the wellbore 12.

A tubing string 22 is lowered into the wellbore 12 and positioned therein as shown in FIG. 1. The tubing string 22 extends to the earth's surface and includes a packer 24, a packer 26, and a tubing string 28 interconnected between the packers 24, 26. Of course, the tubing string 28 and packers 24, 26 could be conveved into the wellbore 12 separate from the remainder of the tubing string 22, as could other portions of the tubing string 22, without departing from the principles of the present invention.

Below the packer 26, the tubing string 22 includes a sump packer 30, a tubular screen 32, and a crossover or sliding sleeve valve 34. It will be readily appreciated by a person of ordinary skill in the art that the portion of the tubing string 22 from the packer 26 to the sump packer 30 is similar to a conventional assembly utilized in stimulation and/or gravel pack operations. Thus, as representatively illustrated in FIG. 1, packer 26 is a conventional fracturing and gravel packing packer, and the formation 14 may be fractured or otherwise stimulated and gravel packed utilizing the tubing string 22 as it is depicted in FIG. 1. It is to be understood, however, that it is not necessary for the formation 14 to be stimulated and/or gravel packed, and it is not necessary for the tubing string 22 to be configured for stimulation and/or gravel packing operations, in accordance with the principles of the present invention.

When the tubing string 22 has been positioned properly within the wellbore 12, the packers 26, 30 are set in the casing 16 and any stimulation and/or gravel packing operations are performed. Of course, the sump packer 30 may have been previously set in the casing 16. Additionally, the formation 14 may have been perforated before the tubing string 22 was conveyed into the wellbore 12, but if not, the formation is perforated before the stimulation and/or gravel packing operations, if any.

The tubing string 28 extending from the packer 24 to the packer 26 includes various items of equipment as shown in FIG. 1. It is to be understood that more or less items of equipment may be used in the tubing string 28, and those items of equipment may be differently configured from that shown in FIG. 1, without departing from the principles of the present invention. As depicted in FIG. 1, the tubing string 28 includes a valve 36, a nipple 38, a seal bore extension 40, a valve 42, an injection sub 44, a sensor sub 46, a valve 48, and a nipple 59.

The valves 36, 48 are of the type which selectively permit or prevent fluid flow radially through sidewall portions thereof. The applicants prefer that the valves 36, 48 are conventional sliding sleeve valves, such as a DURASLEEVE® valve manufactured by, and available from, Halliburton Company of Duncan, Okla., although other valves may be used without departing from the principles of the present invention. The valves 36, 48 enable selective fluid communication between the interior of the tubing string 28 and an annulus 52 formed radially between the wellbore 12 and the tubing string 28, and axially between the packers 24, 26. In a manner that will be more fully described hereinbelow, the valves 36, 48 also permit circulation of fluid through the annulus 52 and interior of the tubing string 28.

The nipple 38 is of the type which permits various items of equipment to be landed, located therein, and/or latched thereto. The applicants prefer that the nipple 38 is a conventional X® nipple manufactured by, and available from, Halliburton Company. In a manner that will be more fully described hereinbelow, the nipple 38 permits another tubing string to be inserted within the tubing string 28 and attached thereto. The seal bore extension 40 is a conventional circumferential sealing device designed for use with the nipple 38, which permits various items of equipment to be sealingly engaged therewith. In a manner that will be more fully described hereinbelow, the seal bore extension 40 permits the other tubing string referred to above to sealingly engage an inner side surface of the tubing string 28. Of course, other latching or locating devices, and other sealing devices, may be utilized in the tubing string 28 without departing from the principles of the present invention, for example, instead of the seal bore extension 40, a circumferential seal may be disposed on the inner side surface of the tubing string 28 to sealingly engage an outer side surface of the other tubing string disposed therein, etc.

The valve 42 is of the type which selectively permits or prevents fluid flow axially through the tubing string 28. The applicants prefer that the valve 42 is a conventional surface controlled subsurface safety valve, although other valves may be used without departing from the principles of the present invention. The valve 42 has a control line 54 connected thereto for controlling operation of the valve 42 in a conventional manner, that is, a level of fluid pressure in the control line determines whether the valve 42 is open or closed. As will be more fully explained hereinbelow, the control line 54 extends from the valve 42 upward, axially through the packer 24, and to the earth's surface.

The injection sub 44 is of the type utilized to inject fluid into a tubing string and may be the type well known to those of ordinary skill in the art as an injection mandrel. The fluid injected through the injection sub 44 may be a corrosion inhibitor, a chemical used to inhibit hydrate formation or paraffin deposits, etc., or some combination thereof. An injection line 56 is connected to the injection sub 44 for communicating the fluid thereto. Similar to the control line 54, the injection line extends upward, through the packer 24, and to the earth's surface.

The sensor sub 46 is of the type well known to those of ordinary skill in the art, sometimes called a gauge carrier, which includes one or more gauges or sensors for sensing properties, such as temperature, pressure, resistivity, etc., in subterranean wells. In the method 10, a sensor of the sensor sub 46 is used to sense the pressure of fluid in the tubing string 28, but it is to be understood that the sensor, or other sensors carried on the sensor sub, may sense fluid pressure in the annulus 52, temperature, etc., without departing from the principles of the present invention. A sensor line 58 is connected to the sensor sub 46 for transmitting readings from the sensor to the earth's surface. Preferably, those readings are in the form of electrical data transmissions and, therefore, the sensor line 58 preferably is one or more wires. The sensor line 58 extends upward from the sensor sub 46, axially through the packer 24, and to the earth's surface.

A sensor 60, which is of the type that may be used in the sensor sub 46, is attached to the packer 24. The sensor 60 is preferably capable of sensing fluid pressure in the annulus 52. Of course, it will be readily apparent that the sensor 60 may be attached elsewhere, for example, to the exterior of the tubing string 28, in order to sense fluid pressure in the annulus 52. Another sensor line 62, similar to sensor line 58, is connected to the sensor 60, extends axially through the packer 24, and extends to the earth's surface. For illustrative convenience, the lines 54, 56, 58, and 62 are depicted in FIG. 1 as being combined into a bundle 64 extending through the packer 24 and to the earth's surface, but it is to be understood that each of the lines may be separately extended through the packer 24 and to the earth's surface. Of course, each of the lines 54, 56, 58, and 62, the bundle 64, or any combination of them, may be strapped to the tubing string 22 in a conventional manner.

Figure 2:
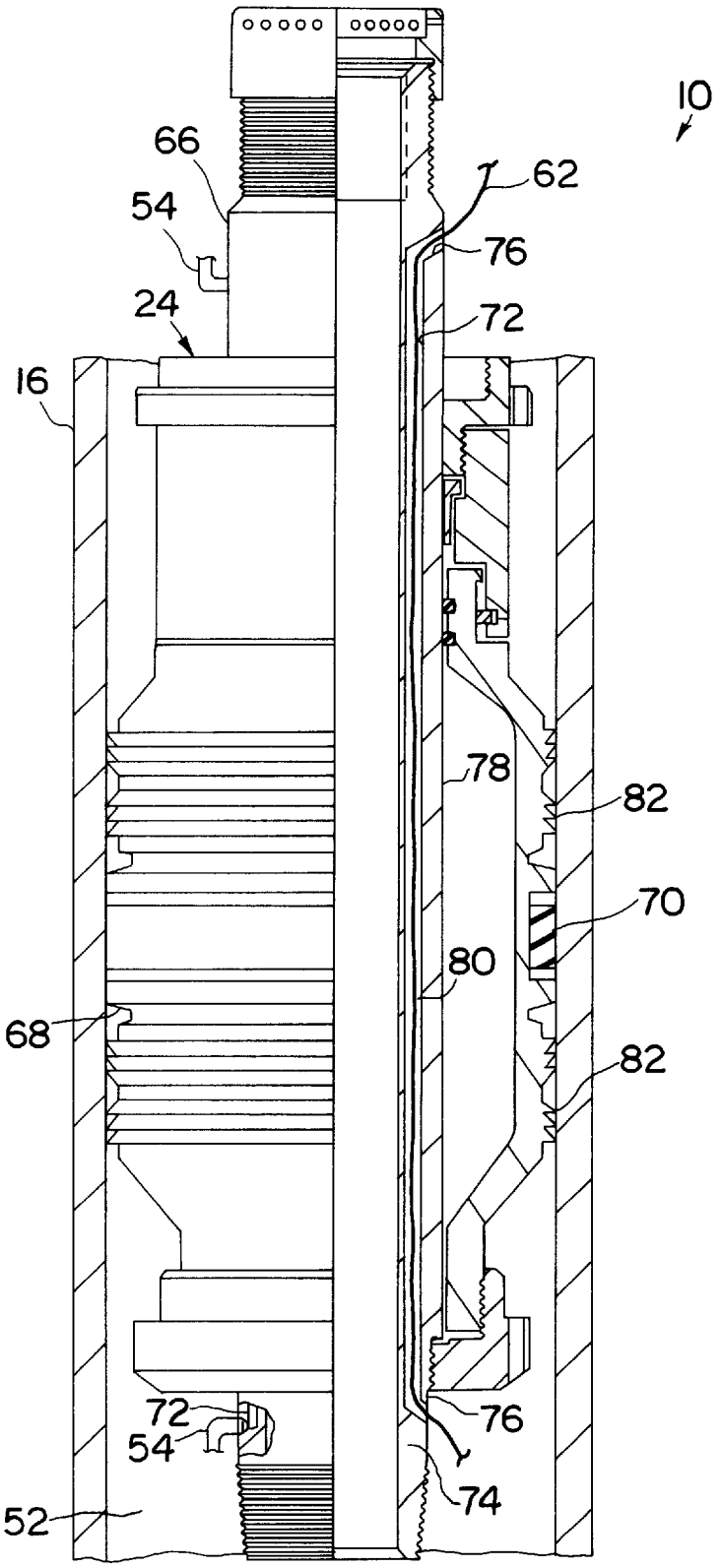
FIG. 2 is an enlarged scale quarter-sectional view through a packer portion of the apparatus of FIG. 1, the packer embodying principles of the present invention.

Referring additionally now to FIG. 2, the packer 24 is representatively illustrated in an enlarged quarter-sectional view, separated from the remainder of the tubing string 22 and set in the casing 16. The packer 24 includes a generally tubular inner mandrel 66, a generally tubular outer housing 68, a circumferential seal element 70, and a conduit 72 extending generally axially within a sidewall portion or wall thickness 74 of the inner mandrel. Although shown in FIG. 2 in a unitary construction, the outer housing 68 may include separate slip and seal element axial portions with connections therebetween, thereby permitting multiple stacked seal element portions and multiple slip portions.

The conduit 72 has opposite ends 76 each of which opens outwardly to an outer side surface 78 of the inner mandrel 66. The conduit 72 visible in FIG. 2 contains a line, such as sensor line 62. Other conduits 72 formed in the inner mandrel 66 may contain, or form a portion of, the other lines 54, 56, 58. For example, the control line 54 may enter one opposite end 76 of one of the conduits 72, extend axially in the conduit, and exit the other opposite end of the conduit, in which case the interior of the control line 54 is isolated from fluid communication with the interior of the conduit 72. Alternatively, the control line 54 may extend from the valve 42 to one opposite end 76 of one of the conduits 72, sealingly engage the opposite end, such that the interior of the control line is in fluid communication with the interior of the conduit and the conduit forms a portion of the control line, sealingly engage the other opposite end of the conduit, and extend therefrom to the earth's surface.

To prevent fluid flow through the conduit 72, a seal structure, such as epoxy 80, may be injected in the conduit to sealingly engage the line 62 (or any other line extending through the conduit) with the conduit, or oring-type seals, backup rings, etc., may be utilized. An alternate seal structure, such as a fluid-tight fitting may be utilized at one or both opposite ends 76 of the conduit. Of course, if the conduit 72 forms a portion of a fluid transmission line, such as the control line 54 or the injection line 56, those lines will preferably sealingly engage the opposite ends 76, for example, utilizing tapered threads, or oring-type seals, backup rings, etc. In that case, it may be desired to install one or more check valves in the conduit 72.

When the packer 24 is set in the casing 16, the outer housing 68 is extended radially outward, as shown in FIG. 2. The seal element 70, which is carried on the outer housing 68, also extends radially outward and sealingly engages the casing 16. Slips 82 extend radially outward and bite into the casing 16 and permit the weight of the tubing string 28, packer 26, etc., therebelow to be hung off, without the need for a separate tubing hanger, and thus aiding in alleviating tubing weight on spar loading.

Figure 3:
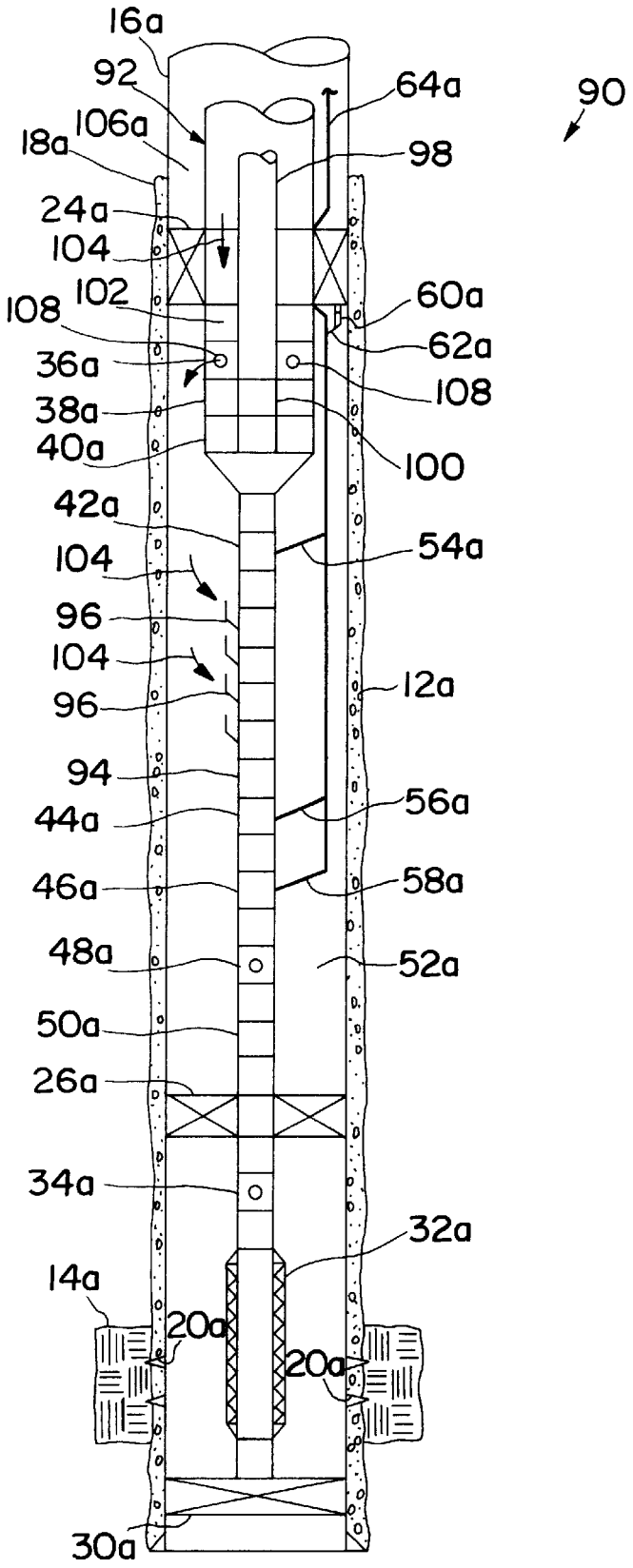
FIG. 3 is a partially elevational and partially cross-sectional schematicized view of the well of FIG. 1, the method and apparatus utilized therein including alternate configurations.

Referring additionally now to FIG. 3, another method 90 embodying principles of the present invention is representatively and schematically illustrated. Elements shown in FIG. 3 which are similar to elements previously described are indicated with the same reference numerals previously used, with an added suffix "a".

In the method 90, a tubing string 92 is used in place of the tubing string 22 of the method 10. The tubing string 92 is in most respects similar to the tubing string 22, except that it includes a tubing string 94 in place of the tubing string 28. The tubing string 94 is interconnected between the packers 24*a*, 26*a* and preferable includes all of the elements of the tubing string 28, with the addition of a series of gas lift mandrels 96 interconnected in a conventional manner between the injection sub 44*a* and the valve 42*a*.

Another tubing string 98 is inserted axially within the tubing string 94 and sealingly engages the sealing device 40*a*. The tubing string 98 includes a conventional device, such as a lock 100 for locating and latching to the nipple 38*a*. The tubing string 98 is, thus, lowered from the earth's surface through the tubing string 92, until it enters the tubing string 94, latches in the nipple 38*a*, and sealingly engages the sealing device 40*a*. At this point, the interior of the tubing string 98 is in fluid communication with the interior of the tubing string 94 below the sealing device 40*a*. Applicants prefer that the tubing string 98 be coiled tubing, but it is to be understood that other tubing may be utilized without departing from the principles of the present invention.

When the tubing string 98 is inserted into the tubing string 94, an annulus 102 is formed radially therebetween. The presence of this annulus 102 permits operations to be performed in the method 90 which significantly enhance the efficiency, safety, and convenience of producing fluid from the formation 14*a*. For example, if gas lift operations are desired to enhance production from the formation 14*a*, the valve 36*a* may be opened and gas (indicated by arrows 104) may be flowed from the earth's surface through the annulus 102, outward through the valve 36*a*, into the annulus 52*a*, to the gas lift mandrels 96, and to the interior of the tubing string 94. In an important aspect of the present invention, the gas lift mandrels 96 may be installed as a part of the tubing string 94 upon initial completion of the well, thereby saving the cost of a workover to install gas lift mandrels later when the formation 14*a* has been partially depleted.

Note that the tubing string 98 may also be installed in the tubing string 28 shown in FIG. 1. It may, for example, be desired to circulate fluid through the tubing string 22. For that purpose, the tubing string 98 may be installed in the tubing string 28 with the valves 36, 42, and 48 open, so that fluid may be flowed through the tubing string 98, through the tubing string 28, through the valve 48, through the annulus 52, through the valve 36, and through the annulus between the tubing strings 22, 98. The direction of such fluid flow would depend upon whether it was desired to circulate or reverse circulate in a particular situation.

The presence of the packer 24 or 24*a* in the method 10 or 90, respectively, is particularly advantageous in deep water completions. In those situations, the packer 74 or 24*a* permits an insulating material, such as a nitrogen blanket, etc., to be placed in an annulus 106 or 106*a* between the tubing string 22 or 92 above the packer 24 or 24*a*. This insulating material serves to insulate the tubing string 22 or 92 from the cold temperatures experienced in relatively deep offshore waters, and aids in mitigating paraffin deposits and hydrate formation. Control of the well is not in danger of being lost in the event of a catastrophic event, such as collapse of the casing 16 or 16*a*, since the packer 24 or 24*a* isolates the annulus 52*a* from the annulus 106*a*, and since the well may be conveniently killed by circulating appropriately weighted fluid through the annulus 52 or 52*a* and tubing string 22 or 92 as described above, even if the casing 16 or 16*a* has been damaged. Also note that the casing 16 or 16*a* will not contain hydrocarbons and so, if the casing does become damaged, no hydrocarbons can leak from the casing into a spar, which would present a safety hazard.

The packer 24 or 24*a* also enables continuous monitoring of bottom hole pressures, both within the tubing string 28 or 94, and within the annulus 52 or 52*a*. Thus, the packer 24 or 24*a* serves somewhat as an isolation packer, but also permits lines, such as lines 54, 56, 58, 62, or 54*a*, 56*a*, 58*a*, 62, including both fluid transmission and electrical transmission lines to extend axially therethrough. If the control line 64 or 64*a* is severed, such as if a production riser is damaged, the valve 54 or 54*a* preferably closes in a conventional manner to prevent fluid from flowing from the formation 14 or 14*a* uncontrollably to the earth's surface.

Where gas lift operations are utilized, such as in method 90 shown in FIG. 3, it may be desirable to install a check valve in the annulus 102 or on the valve 36*a*, in order to ensure that, in a catastrophic event, flow from the annulus 52*a* is not permitted inwardly through the valve 36*a*. For example check valves 108 may be incorporated in external ports of the valve 36*a*.

Figure 4:
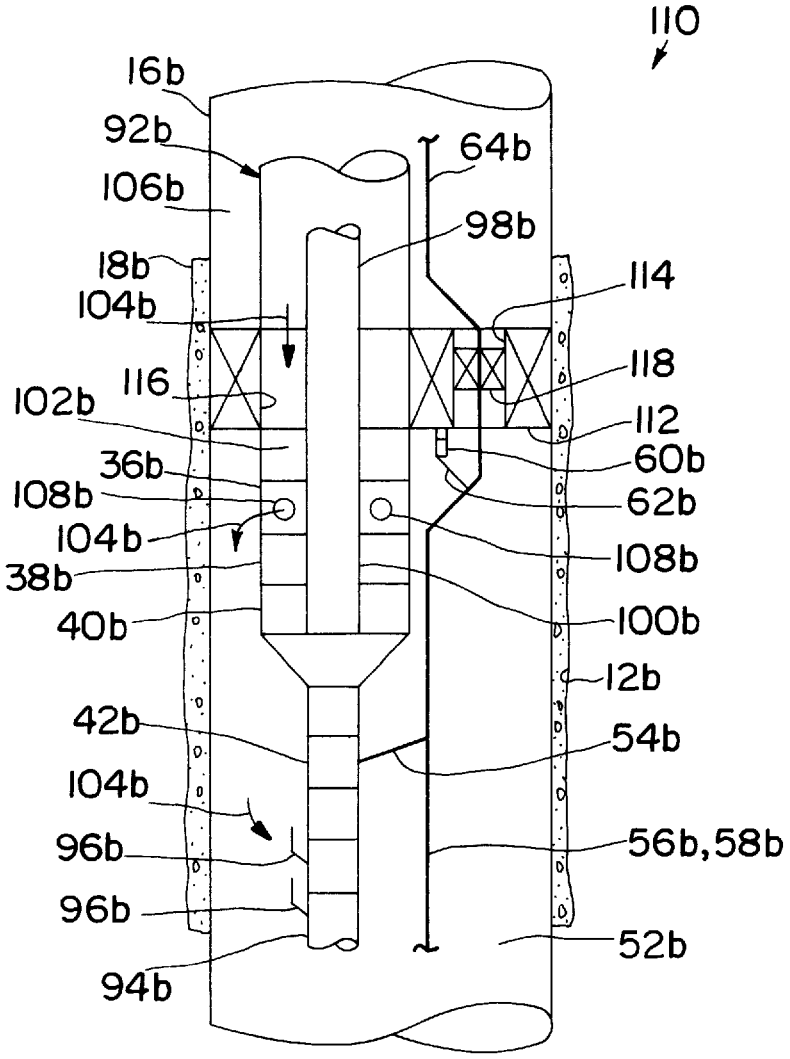
FIG. 4 is a partially elevational and partially cross-sectional schematicized view of a portion of the well of FIG. 3, the method and apparatus utilized therein including an additional alternate configuration.

Referring additionally now to FIG. 4, another method 110 incorporating principles of the present invention is representatively and schematically illustrated. Elements shown in FIG. 4 which are similar to those previously described are indicated utilizing the same reference numerals, with an added suffix "b".

The method 110 utilizes an alternate means of extending one or more of the lines 54*b*, 56*b*, 58*b*, 62*b* through a packer 112. The packer 112 in the method 110 is of the type well known to those of ordinary skill in the art as a multiple bore packer (representatively, a dual string packer in FIG. 4). In the method 110, the lines 54*b*, 56*b*, 58*b*, 62*b*, or any one of them, or any combination of them, are disposed in an axial bore 114 extending through the packer 112. The tubing string 92*b* is connected to, or extends axially through, the other axial bore 116. A seal structure 118 sealingly engages the axial bore 114 and the lines 54*b*, 56*b*, 58*b*, 62*b* to thereby prevent fluid flow axially through the bore 114. Alternatively, the line bundle 64*b* as a unit may be sealingly engaged by the seal structure 118. In other respects, the method 110 is similar to the method 90, the packer 112 replacing the packer 24*a*.

Of course, modifications, additions, substitutions, etc., may be made in the above-described methods 10, 90, 110 and associated apparatus which would be obvious to one of ordinary skill in the art, and such modifications, etc., are within the principles of the present invention. Accordingly, the foregoing detailed description is to be clearly understood as being given by way of illustration and example only, the spirit and scope of the present invention being limited solely by the appended claims.

What is claimed is:

1. Apparatus for use in producing a subterranean well, the well having a wellbore intersecting a formation from which fluid is to be flowed to the earth's surface, the apparatus comprising:

a first packer having a first axial fluid passage, the first packer being settable in the wellbore between the formation and the earth's surface;

a second packer having a second axial fluid passage, the second packer being settable in the wellbore between the first packer and the earth's surface; and a first tubing string interconnecting the first and second fluid passages, the first tubing string including a first valve selectively permitting and preventing fluid flow axially through the first tubing string, and the first tubing string further including a second valve interconnected between the first valve and the second packer, the second valve selectively permitting and preventing fluid flow through a sidewall portion of the first tubing string.

2. The apparatus according to claim 1, wherein the first valve is a safety valve.

3. The apparatus according to claim 2, wherein the safety valve is a surface controlled subsurface safety valve having a control line operatively connected thereto, the control line extending to the earth's surface.

4. The apparatus according to claim 3, wherein the control line extends axially through the second packer.

5. The apparatus according to claim 4, wherein the second packer includes a generally tubular inner mandrel having inner and outer side surfaces, and the inner mandrel further having a generally axially extending conduit formed between the inner and outer side surfaces.

6. The apparatus according to claim 5, wherein the control line sealingly engages the conduit, and the interior of the control line being in fluid communication with the interior of the conduit, the conduit thereby forming a portion of the control line.

7. The apparatus according to claim 5, wherein the control line extends axially through the conduit, and the interior of the control line is isolated from fluid communication with the interior of the conduit.

8. The apparatus according to claim 4, wherein the second packer is a multiple bore packer, and wherein the control line extends through an axial bore of the multiple bore packer.

9. The apparatus according to claim 1, wherein the first tubing string further includes a circumferential sealing device interconnected between the first and second valves.

10. The apparatus according to claim 9, further comprising a second tubing string disposed at least partially within the first tubing string and sealingly engaging the sealing device, the second tubing string extending to the earth's surface.

11. The apparatus according to claim 10, wherein an annulus is formed radially between the first and second tubing strings, wherein the annulus extends at least axially into the second valve, and wherein when the second valve is open, fluid communication is permitted between the annulus and the exterior of the second valve.

12. The apparatus according to claim 1, wherein the first tubing string further includes an injection member.

13. The apparatus according to claim 12, wherein the injection member is interconnected between the first valve and the first packer.

14. The apparatus according to claim 12, further comprising an injection line connected to the injection member, the injection line extending axially through the second packer.

15. The apparatus according to claim 1, wherein the first tubing string further includes a sensor.

16. The apparatus according to claim 15, wherein the sensor is interconnected between the first valve and the first packer.

17. The apparatus according to claim 15, further comprising a sensor line connected to the sensor, the sensor line extending axially through the second packer.

18. The apparatus according to claim 1, further comprising a sensor attached to the second packer, and a sensor line connected to the sensor and extending axially through the second packer.

19. The apparatus according to claim 1, wherein the first tubing string further includes a third valve interconnected between the first valve and the first packer, the third valve selectively permitting and preventing fluid flow through a sidewall portion thereof.

20. Apparatus for use in producing a subterranean well, the well having a wellbore intersecting a formation from which fluid is to be flowed to the earth's surface, the apparatus comprising:

a first packer having a first axial fluid passage, the first packer being settable in the wellbore between the formation and the earth's surface;

a second packer having a second axial fluid passage, the second packer being settable in the wellbore between the first packer and the earth's surface; and a first tubing string interconnecting the first and second fluid passages, and the first tubing string including a first valve, the first valve selectively permitting and preventing fluid flow outwardly through a sidewall portion thereof.

21. The apparatus according to claim 20, wherein the first tubing string further includes a circumferential sealing device interconnected between the first valve and the first packer.

22. The apparatus according to claim 21, further comprising a second tubing string disposed at least partially within the first tubing string and sealingly engaging the sealing device, such that the interior of the first tubing string is in fluid communication with the interior of the second tubing string.

23. The apparatus according to claim 22, wherein an annulus is formed between the first and second tubing strings, and wherein fluid communication is permitted between the annulus and the exterior of the first tubing string when the first valve is open.

24. The apparatus according to claim 20, wherein the first tubing string further includes a second valve, the second valve selectively permitting and preventing fluid flow axially through the first tubing string.

25. The apparatus according to claim 24, wherein the first tubing string further includes a third valve interconnected between the first packer and the second valve, the third valve selectively permitting and preventing fluid flow through a sidewall portion of the first tubing string.

26. The apparatus according to claim 24, wherein the second valve is a safety valve.

27. The apparatus according to claim 26, wherein the safety valve has a control line operatively connected thereto.

28. The apparatus according to claim 27, wherein the control line extends axially through the second packer.

29. The apparatus according to claim 28, wherein the second packer includes a generally tubular member having a wall thickness and a generally axially extending conduit formed through the wall thickness.

30. The apparatus according to claim 28, wherein the second packer is a multiple bore packer, the control line extending through an axial bore of the multiple bore packer.

31. The apparatus according to claim 20, wherein the first tubing string further includes an injection member interconnected between the first valve and the first packer.

32. The apparatus according to claim 31, further comprising an injection line operatively connected to the injection member, the injection line extending axially through the second packer.

33. The apparatus according to claim 20, wherein the first tubing string further includes a fluid property sensor.

34. The apparatus according to claim 33, wherein the fluid property sensor is capable of sensing a property of the fluid flowing through the first tubing string between the first and second fluid passages.

35. The apparatus according to claim 33, further comprising a sensor line connected to the fluid property sensor, the sensor line extending axially through the second packer.

36. The apparatus according to claim 20, further comprising a fluid property sensor attached to the second packer, and a sensor line operatively connected to the fluid property sensor and extending axially through the second packer.

37. Apparatus for use in producing a subterranean well, the well having a wellbore intersecting a formation from which fluid is to be flowed to the earth's surface, the apparatus comprising:

a first packer having an axially extending mandrel, the mandrel having a first fluid passage formed axially therethrough, and the first packer being settable in the wellbore;

a first tubing string operatively connected to the mandrel and extending outwardly therefrom, the first tubing string having an inner side surface and including a first valve; and a second tubing string sealingly engaging a portion of the first tubing string inner side surface, the first tubing string at least partially radially outwardly surrounding the second tubing string between the portion of the first tubing string inner side surface and the first packer mandrel, the first valve being interconnected between the portion of the first tubing string inner side surface and the first packer mandrel, and the first valve selectively permitting and preventing fluid communication between the exterior of the first tubing string and an annulus formed radially between the first and second tubing strings.

38. The apparatus according to claim 37, wherein the first tubing string further includes a second valve, the portion of the first tubing string inner side surface being interconnected between the first and second valves, and the second valve selectively permitting and preventing fluid flow axially through the first tubing string.

39. The apparatus according to claim 38, wherein the second valve has a control line operatively connected thereto, the second valve being responsive to a fluid pressure in the control line for selectively opening and closing the second valve.

40. The apparatus according to claim 39, wherein the control line extends axially through the first packer.

41. The apparatus according to claim 40, wherein the control line extends axially through a sidewall portion of the first packer mandrel.

42. The apparatus according to claim 40, wherein the control line extends axially through an axial bore of the first packer.

43. The apparatus according to claim 37, further comprising a second packer capable of being set in the wellbore, and wherein the first tubing string is interconnected between the mandrel and the second packer.

44. The apparatus according to claim 37, wherein the first tubing string further includes an injection member.

45. The apparatus according to claim 44, wherein the portion of the first tubing string inner side surface is interconnected between the injection member and the first packer.

46. The apparatus according to claim 44, further comprising an injection line connected to the injection member, the injection line extending axially through the first packer.

47. The apparatus according to claim 37, wherein the first tubing string further includes a sensor.

48. The apparatus according to claim 47, wherein the portion of the first tubing string inner side surface is interconnected between the sensor and the first packer.

49. The apparatus according to claim 47, further comprising a sensor line connected to the sensor, the sensor line extending axially through the first packer.

50. The apparatus according to claim 37, further comprising a sensor attached to the first packer, and a sensor line connected to the sensor and extending axially through the first packer.

51. The apparatus according to claim 37, wherein the first tubing string further includes a first valve, the first valve selectively permitting and preventing fluid flow through a sidewall portion thereof, and the portion of the first tubing string inner side surface being interconnected between the first valve and the first packer.

52. Apparatus operatively positionable within a subterranean wellbore, the apparatus comprising:

a generally tubular inner mandrel having inner and outer side surfaces;

a generally tubular outer housing at least partially radially outwardly circumscribing the inner mandrel;

a circumferential seal element carried adjacent the outer housing for sealingly engaging the wellbore; and a generally axially extending conduit formed in the inner mandrel between the inner and outer side surfaces, the outer housing being radially outwardly extendable relative to the inner mandrel, and the seal element being radially outwardly extended when the outer housing is radially outwardly extended.

53. The apparatus according to claim 52, wherein the conduit has opposite ends, each of the opposite ends forming an opening on the inner mandrel outer side surface.

54. The apparatus according to claim 53, wherein the outer housing is disposed axially between the openings on the inner mandrel outer side surface.

55. The apparatus according to claim 52, wherein the conduit has opposite ends, each of the opposite ends being adapted for sealing attachment thereto of a fluid transmission line, the conduit forming a portion of the fluid transmission line when the fluid transmission line is sealingly attached thereto.

56. The apparatus according to claim 52, wherein the outer housing carries the seal element thereon, the seal element radially outwardly circumscribing the outer housing.

57. The apparatus according to claim 52, further comprising an electrical transmission line extending through the conduit.

58. The apparatus according to claim 57, further comprising a seal structure sealingly engaging the electrical transmission line.

59. A method of producing a subterranean well, the well having a wellbore intersecting a formation from which fluid is to be flowed to the earth's surface, the method comprising the steps of:

providing a first packer having a first axial fluid passage;

providing a second packer having a second axial fluid passage;

providing a first tubing string including a first valve selectively permitting and preventing fluid flow axially through the first tubing string, and a second valve selectively permitting and preventing fluid flow through a sidewall portion thereof;

interconnecting the first tubing string between the first and second axial fluid passages, the second valve being interconnected between the first valve and the first racker;

setting the first packer in the wellbore between the formation and the earth's surface; and setting the second packer in the wellbore between the first packer and the earth's surface.

60. The method according to claim 59, further comprising the step of connecting a control line to the first valve, and wherein the first valve is responsive to fluid pressure in the control line for selectively permitting and preventing fluid flow through the first tubing string.

61. The method according to claim 60, further comprising the step of extending the control line axially through the second packer.

62. The method according to claim 61, wherein the step of extending the control line includes sealingly engaging the control line with a conduit extending generally axially within a sidewall of an inner mandrel of the second packer, the interior of the conduit being in fluid communication with the interior of the control line.

63. The method according to claim 61, wherein the step of extending the control line includes inserting the control line through a conduit extending generally axially within a sidewall of an inner mandrel of the second packer, the interior of the conduit being isolated from fluid communication with the interior of the conduit.

64. The method according to claim 61, wherein the step of extending the control line includes inserting the control line through an axially extending bore of the second packer, and wherein the second packer is a dual string packer.

65. The method according to claim 59, further comprising the steps of providing a third valve and interconnecting the third valve in the first tubing string between the first valve and the second packer, the third valve selectively permitting and preventing fluid flow through a sidewall portion thereof.

66. The method according to claim 65, further comprising the steps of providing a circumferential sealing device and interconnecting the sealing device in the first tubing string between the first and third valves.

67. The method according to claim 66, further comprising the steps of providing a second tubing string, disposing the second tubing string at least partially within the first tubing string, and sealingly engaging the second tubing string with the sealing device.

68. The method according to claim 67, further comprising the step of flowing a fluid from the earth's surface, through an annulus formed radially between the first and second tubing strings, outwardly through the third valve sidewall portion, and into the wellbore.

69. The method according to claim 68, further comprising the steps of providing a gas lift device, interconnecting the gas lift device in the first tubing string between the first valve and the first packer, and flowing the fluid from the earth's surface inwardly through the gas lift device.

70. The method according to claim 59, further comprising the steps of providing an injection device and interconnecting the injection device in the first tubing string between the first valve and the first packer.

71. The method according to claim 70, further comprising the steps of providing an injection line, connecting the injection line to the injection member, and extending the injection line axially through the second packer.

72. The method according to claim 59, further comprising the steps of providing a sensor and interconnecting the sensor in the first tubing string between the first valve and the first packer.

73. The method according to claim 72, further comprising the steps of providing a sensor line, connecting the sensor line to the sensor, and extending the sensor line axially through the second packer.

74. The method according to claim 59, further comprising the steps of providing a sensor and attaching the sensor to the second packer.

75. The method according to claim 74, further comprising the steps of providing a sensor line, connecting the sensor line to the sensor, and extending the sensor line axially through the second packer.

76. The method according to claim 59, further comprising the steps of providing a third valve, interconnecting the third valve in the first tubing string between the first valve and the second packer, the third valve selectively permitting and preventing fluid flow through a sidewall portion thereof, providing a circumferential sealing device, interconnecting the sealing device in the first tubing string between the first and third valves, providing a second tubing string, disposing the second tubing string at least partially within the first tubing string, sealingly engaging the second tubing string with the sealing device, and flowing a fluid from the earth's surface, through an annulus formed radially between the first and second tubing strings, outwardly through the third valve sidewall portion, into the wellbore, and inwardly through the second valve sidewall portion.

77. A method of producing a subterranean well, the well having a wellbore intersecting a formation from which fluid is to be flowed to the earth's surface, the method comprising the steps of:

providing a first packer having a first axial fluid passage;

providing a second packer having a second axial fluid passage;

providing a first tubing string including a first valve, the first valve selectively permitting and preventing fluid flow outwardly through a sidewall portion thereof: and interconnecting the first tubing string between the first and second axial fluid passages.

78. The method according to claim 77, further comprising the steps of providing a circumferential sealing device and interconnecting the sealing device in the first tubing string between the first valve and the first packer.

79. The method according to claim 78, further comprising the steps of providing a second tubing string, disposing the second tubing string at least partially within the first tubing string, and sealingly engaging the second tubing string with the sealing device.

80. The method according to claim 79, further comprising the steps of opening the first valve and flowing fluid from the earth's surface, through an annulus formed radially between the first and second tubing strings, outwardly through the first valve sidewall portion, and into the wellbore.

81. The method according to claim 77, further comprising the steps of providing a second valve and interconnecting the second valve in the first tubing string, the second valve selectively permitting and preventing fluid flow axially through the first tubing string.

82. The method according to claim 81, further comprising the steps of providing a third valve and interconnecting the third valve in the first tubing string between the first packer and the second valve, the third valve selectively permitting and preventing fluid flow through a sidewall portion thereof.

83. The method according to claim 81, further comprising the steps of connecting a control line to the second valve and extending the control line axially through the second packer, and wherein the second valve is a safety valve responsive to fluid pressure within the control line.

84. The method according to claim 83, wherein the step of extending the control line includes extending the control line through a sidewall portion of an inner mandrel of the second packer.

85. The method according to claim 77, wherein the step of providing the second packer further includes providing the second packer having an inner mandrel, the inner mandrel having a generally axially extending conduit formed within a wall thickness thereof.

86. The method according to claim 85, wherein the step of providing the second packer further includes providing the second packer having a sensor attached to an outer surface thereof, and further comprising the steps of connecting a sensor line to the sensor and extending the sensor line through the conduit.

87. A method of producing a subterranean well, the well having a wellbore intersecting a formation from which fluid is to be flowed to the earth's surface, the method comprising the steps of:

providing a first packer having an axially extending mandrel, the mandrel having a first fluid passage formed axially therethrough;

providing a first tubing string having an inner side surface and a first valve;

connecting the first tubing string to the mandrel;

setting the first packer in the wellbore;

providing a second tubing string;

disposing the second tubing string at least partially within the first tubing string; and sealingly engaging the second tubing string with a portion of the first tubing string inner side surface, the first valve being interconnected between the first packer and the portion of the first tubing string inner side surface.

88. The method according to claim 87, wherein in the sealingly engaging step, the first valve is interconnected in the first tubing string between the first packer mandrel and the portion of the first tubing string inner side surface.

89. The method according to claim 88, further comprising the steps of providing a second valve and interconnecting the second valve in the first tubing string, the portion of the tubing string inner side surface being interconnected between the first and second valves, and the second valve selectively permitting and preventing fluid flow axially through the first tubing string.

90. The method according to claim 89, further comprising the steps of connecting a control line to the second valve and extending the control line axially through the second packer, the second valve being responsive to fluid pressure in the control line for selectively opening and closing the second valve.

91. The method according to claim 87, further comprising the steps of providing a second packer, interconnecting the second packer to the first tubing string, the first tubing string being interconnected between the mandrel and the second packer, and setting the second packer in the wellbore.

92. The method according to claim 91, further comprising the steps of providing a gas lift mandrel, interconnecting the gas lift mandrel in the first tubing string between the portion of the first tubing string inner side surface and the second packer, and flowing gas from the earth's surface through a gas flowpath extending through an annulus formed between the first and second tubing strings, outward through the first valve, into an annulus formed between the first tubing string and the wellbore, and into the interior of the first tubing string through the gas lift mandrel.

93. The method according to claim 92, further comprising the step of installing a check valve in the gas flowpath.

94. The method according to claim 87, further comprising the step of installing an insulating material in an annulus formed between the wellbore and a production tubing string extending from the first packer to the earth's surface.

95. The method according to claim 87, wherein in the step of setting the first packer in the wellbore, the weight of the first tubing string being suspended from the first packer.

96. The method according to claim 87, further comprising the steps of providing a sensor, attaching the sensor to the first packer, connecting a sensor line to the sensor, and extending the sensor line axially through the first packer.

* * * * *